United States Patent [19]

Nobile et al.

[11] Patent Number: 4,903,633

[45] Date of Patent: Feb. 27, 1990

[54] FLUID SUPPLY APPARATUS

[75] Inventors: John R. Nobile, Fairfield; William A. Ross, Darien, both of Conn.

[73] Assignee: Pitney Bowes Inc., Stamford, Conn.

[21] Appl. No.: 353,944

[22] Filed: May 19, 1989

[51] Int. Cl.[4] ..... B05C 1/02

[52] U.S. Cl. ..... 118/268

[58] Field of Search ..... 118/268, 264, 270

[56] References Cited

U.S. PATENT DOCUMENTS

| | | | |
|---|---|---|---|
| 3,426,888 | 2/1969 | Meth | 118/270 |
| 3,811,407 | 5/1974 | Lupkas et al. | 118/264 |
| 3,960,632 | 6/1976 | Gaines et al. | 118/264 |
| 4,091,489 | 5/1978 | Nimetz | 118/268 |
| 4,180,159 | 12/1979 | Tanaka | 118/268 |

FOREIGN PATENT DOCUMENTS 852361 1/1940 France .

*Primary Examiner*—Willard Hoag

*Attorney, Agent, or Firm*—Donald P. Walker; Melvin J. Scolnick; David E. Pitchenik

[57] ABSTRACT

Fluid supply apparatus comprising: a hollow container made of a resilient plastic material, the container including an upper wall, the upper wall including first and second wells formed therein and extending into the interior of the container, one of said wells forming a fluid inlet opening; a pad made of a wicking material, the other of said wells forming a fluid outlet opening, said pad mounted within the other of said wells and extending from said container via said fluid outlet opening; and the container including a side wall having a generally S-shaped transverse cross-section.

9 Claims, 7 Drawing Sheets

FLUID SUPPLY APPARATUS

BACKGROUND OF THE INVENTION

The present invention is generally concerned with envelope moistening apparatus and more particularly with apparatus for moistening envelope flaps including resilient means for maintaining a flap moistening applicator in engagement with moisture supplying means.

As shown in U.S. Pat. No. 3,884,745 for Envelope Moistening and Sealing Apparatus, issued May 20, 1975 to Paul R. Sette, et al, and assigned to the assignee of the present invention, it is known in the art to provide a spring for resiliently biasing a moisture applicator holder toward an envelope flap guide plate having a plurality of windows formed therein, for causing the applicator held thereby to protrude through the windows and into engagement with moisture supplying structure.

Moreover, as shown in U.S. Pat. No. 3,859,955 for an Envelope Moistening Device for a Postage Meter, issued Jan. 14, 1975 to Walter T. Labore and assigned to the assignee of the present invention, it is known in the art to form a flexible hinge in a moisture applicator holder, which is made of resilient material, for resiliently biasing the applicator removably held thereby into the path of travel of an envelope flap, against the force exerted by the flap on the applicator holder. Moreover, the Labore Patent discloses the provision of simplified structure for removably attaching the moisture applicator holder to an envelope flap stripper blade.

Although the hinge structure of the Labore Patent simplifies the structure of the Sette et al Patent by eliminating the Labore's spring and providing the aforesaid simplified stripper blade attachment structure, customers have experienced certain difficulties in the course of removing the applicators and applicator holders for cleaning purposes, as discussed more fully in the U.S. patent application No. 4,643,123 for an Envelope Moistening Apparatus, issued Feb. 17, 1987 to David R. Auerbach and assigned to the assignee of the present invention. Thus, to further simplify the Sette et al structure, provision is made in the Auerbach Patent for a moisture applicator holder made of a resilient plastic material which is removably attachable to a hinge against the resilient force exerted by the holder on the hinge. On the other hand, no provision is made in the Auerbach Patent for resiliently biasing the moisture applicator toward, or maintaining the moisture applicator in engagement with, the moisture supplying structure or an envelope flap.

Aside from the foregoing matters, the above discussed Patents are silent with regard to the provision of simply constructed and easily serviceable fluid and moisture supplying structure.

Accordingly:

An object of the invention is to provide improved envelope flap moistening apparatus;

Another object is to provide envelope flap moistening apparatus including means for resiliently biasing moisture applying structure, including a pad, toward a supply of fluid, and maintaining the pad in engagement with the moisture supply;

Another object is to provide improved means for resiliently biasing moisture applying structure, including a pad, toward and in engagement with an envelope flap; and Another object is to provide improved fluid supply apparatus;

Another object is to provide an improved mailing machine base; and

Yet another object is to provide improved moisture applying apparatus including a pad made of a wicking material.

SUMMARY OF THE INVENTION

Fluid supply apparatus comprising: a hollow container made of a resilient plastic material, the container including an upper wall, the upper wall including first and second wells formed therein and extending into the interior of the container, one of said wells forming a fluid inlet opening; a pad made of a wicking material, the other of said wells forming a fluid outlet opening, said pad mounted within the other of said wells and extending from said container via said fluid outlet opening; and the container including a side wall having a generally S-shaped transverse cross-section.

BRIEF DESCRIPTION OF THE DRAWINGS

As shown in the drawings wherein like reference numerals designate like or corresponding parts throughout the several views.

DESCRIPTION OF THE PREFERRED EMBODIMENT

Figure 1:
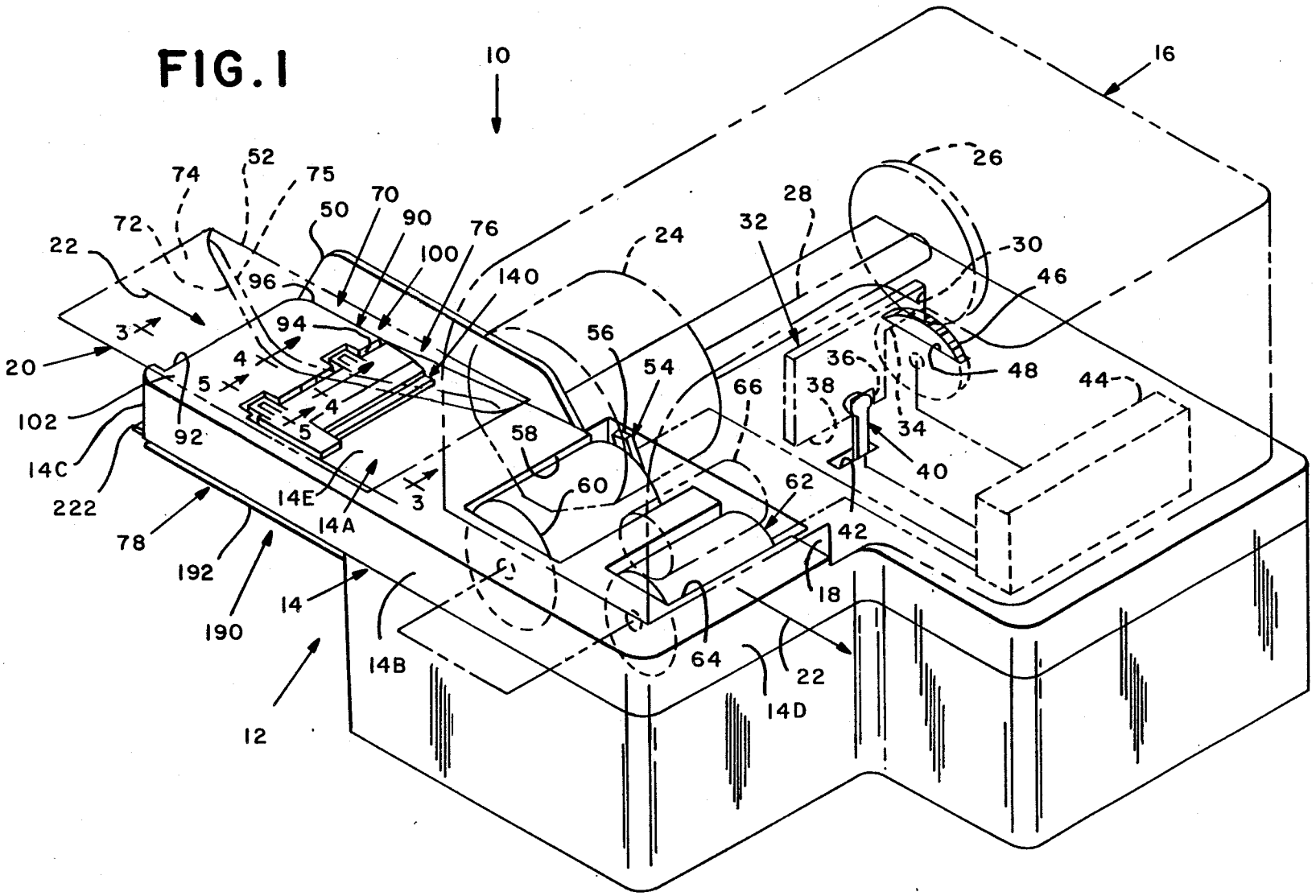
FIG. 1 is a partially phantom, perspective, view of a mailing machine, including a postage meter removably mounted on a base, showing envelope flap moistening apparatus according to the invention.

As shown in FIG. 1, the apparatus in which the invention may be incorporated generally includes a mailing machine 10 which includes a base 12, having a housing 14, and a postage meter 16 which is removably mounted on the base 12. The housing 14 includes an upper feed deck 14A, and includes a front skirt wall 14B and opposed end skirt walls 14C and 14D which respectively depend from the deck 14A. When mounted on the base 12, the postage meter 16 forms therewith a slot 18 through which sheets 20, including mailpieces such as letters, envelopes, cards or other sheet-like materials, may be fed in a downstream path of travel 22 on the deck 14A.

The postage meter 16 (FIG. 1) generally comprises rotary printing structure including a postage printing drum 24 and a drive gear 26 therefor. The drum 24 and drive gear 26 are spaced apart from one another and mounted on a common drum drive shaft 28. The drum 24 is conventionally constructed and arranged for feeding the respective sheets 20 in the path of travel 22, which extends beneath the drum 24, and for printing postage data, registration data or other selected indicia on the upwardly disposed surface of each sheet 20. The drum drive gear 26 has a key slot 30 formed therein, which is located vertically beneath the drum drive shaft 28 when the postage meter drum 24 and drive gear 26 are located in their respective home positions. The postage meter 16 additionally includes a drive gear locking member 32, known in the art as a shutter bar. The shutter bar 32 includes an elongate key portion 34 which is transversely dimensioned to fit into the drive gear's key slot 30. The shutter bar 32 is conventionally reciprocably mounted within the postage meter 16 for movement toward and away from the drum drive gear 26, to permit moving the shutter bar's key portion 34 into and out of the key slot 30, under the control of the mailing machines base 12, when the drum drive gear 26 is located in its home position. To that end, the shutter bar 32 has a channel 36 formed thereinto from its lower surface 38, and, the mailing machine's base 12 includes a movable lever arm 40, which extends upwardly through an aperture 42 formed in the housing 14, when the meter 16 is mounted on the base 10, and fits into the channel 36 in bearing engagement with the shutter bar 32 for reciprocally moving the bar's key portion 34 into and out of locking engagement with the drum drive gear 26. And, for driving the lever arm 40 and drum gear 26, the base 12 includes a drive system 44. The drive system 44 is conventionally constructed and arranged for timely moving the lever arm 40 and rotating the drum drive gear 26, and includes an output gear 46 which extends upwardly through another housing aperture 48 and into meshing engagement with the drum gear 26.

The base 12 (FIG. 1) additionally includes a registration fence 50. Preferably, the fence 50 is integrally formed with the housing 14, such that the fence 50 extends vertically upwardly from the feed deck 14A and is aligned with the path of travel 22, to permit an edge 52 of a given sheet 20 to be urged against the fence 50 and into alignment with the path of travel 22 when the sheet 20 is fed to the feed deck 14A. Further, the base 12 includes drive system trip structure 54 for sensing sheets 20 fed to the machine 10. The trip structure 54 is conventionally connected to the drive system 44 and includes a movable trip lever 56 which extends upwardly through another housing aperture 58 and into the path of travel 22 to permit each sheet 20 fed to the mailing machine 10 to engage and move the lever 56. Moreover, the base 12 includes a conventional input feed roller 60, known in the art as an impression roller. The impression roller 60 is conventionally connected to the drive system 44 and yieldably mounted to extend upwardly through the housing aperture 58 and into the path of travel 22 for urging each sheet into printing engagement with the drum 24 and cooperating therewith for feeding the sheets 20 through the machine 10.

For feeding sheets 20 (FIG. 1) from the mailing machine 10, the base 12 includes a conventional output feed roller 62, known in the art as an ejection roller. The ejection roller 62 is conventionally connected to the drive system 44 and extends upwardly through a further housing aperture 64 and into the path of travel 22. Moreover, the postage meter 16 includes a suitable idler roller 66 which is conventionally yieldably mounted to extend downwardly into the path of travel 22 and cooperate with the ejection roller 62 for feeding sheets 20 from the machine 10.

According to the invention, the mailing machine 10 (FIG. 1) generally includes envelope flap deflecting apparatus 70 for deflecting an envelope flap 72 (FIG. 3) of an open envelope 20 from the envelope body 74, to expose for moistening purposes the gummed, adhesive, strip of material 75 which is conventionally affixed to the interior surface of the envelope flap 72. In addition, according to the invention, the mailing machine 10 comprises an improved sheet feed deck 14A, and flap moistening apparatus 76 (FIG. 3) including a source of supply 78 of flap moistening fluid 80.

The flap deflecting apparatus 70 (FIG. 2) includes an elongate, horizontally-extending, blade-shaped arm 90, which is known in the art as a stripper blade. The stripper blade 90 has an elongate, knife-like, leading edge 92 and an elongate trailing edge 94, and has a side edge 96 which extends between the leading and trailing edges 92 and 94. The stripper blade 90 is preferably integrally formed with housing's front skirt wall 14B, overhangs the deck 14A and horizontally extends towards the registration fence 50, for disposing the stripper blade's longitudinally-extending leading and trailing edges, 92 and 94, transverse to the direction of the path of travel 22, and for disposing the stripper blade's side edge 96 in facing relationship with the registration fence 50. As thus constructed and arranged, the stripper blade 90 defines a channel 98 between the stripper blade 90 and feed deck 14A and also defines an elongate gap 100, extending in the direction of the path of travel 22, between the stripper blade's side edge 96 and the registration fence 50. Further, the stripper blade 90 has a horizontally-extending upper surface 102, on which sheets 20 are disposed when fed to the machine 10, and has a lower surface 104 (FIG. 3) from which at least one rib 105 depends.

The stripper blade 90 (FIG. 2) additionally includes a plurality of elongate upper and lower hinge segments 106 and 108, preferably three, which are alternately formed in the stripper blade 90 at intervals alongside the trailing edge 94. Each of the hinge segments, 106 and 108, transversely extends downstream from an imaginary line 110, extending parallel to the stripper blade's trailing edge 94. Preferably, the two upper hinge segments 106 are formed in the stripper blade's upper surface 102, and the one lower hinge segment 108 is formed in the stripper blade's lower surface 104 midway between the two upper segments 106. Each of the two upper segments 106 includes an upstream channel 112 having a base surface 114 which is inclined inwardly of the stripper blade's upper surface 102 and extends toward the trailing edge 94. Preferably, the channel base 114 (FIG. 4) is inclined at an angle of twenty-five degrees (25°) relative to a given horizontally-extending plane, such as the stripper blade's upper horizontally-extending surface 102, thereby forming an upwardly inclined angle of twenty-five degrees (25°) from an imaginary horizontal plane 115 extending through the downstream end of the channel base 114. Further, each of upper hinge segments 106 includes a downstream portion 116 having a surface 118 which arcuately, convexly upwardly, extends from the downstream end of the channel base 114, to the stripper blade's trailing edge 94. The lower hinge segment 108 (FIG. 2) includes an upstream channel 120 (FIG. 4) having a base surface 122 within the stripper blade 90 which horizontally extends downstream and toward the trailing edge 94. In addition, the lower hinge segment 108 includes a downstream portion 124 having a surface 126 which arcuately, concavely downwardly, extends from the downstream end of the channel base 122 to the stripper blade's trailing edge 94. Thus as viewed from the stripper blade's trailing edge 94, the upper elongate hinge segments 106 each extend upstream from the trailing edge 94 and include a first upper convexly-shaped surface transversely-extending from the trailing edge 94 and a second inclined surface transversely-extending from the convexly-shaped surface. Whereas the lower elongate hinge segment 108 extends upstream from the trailing edge 94 and includes a lower concavely-shaped surface extending from the trailing edge 94.

Figure 2:
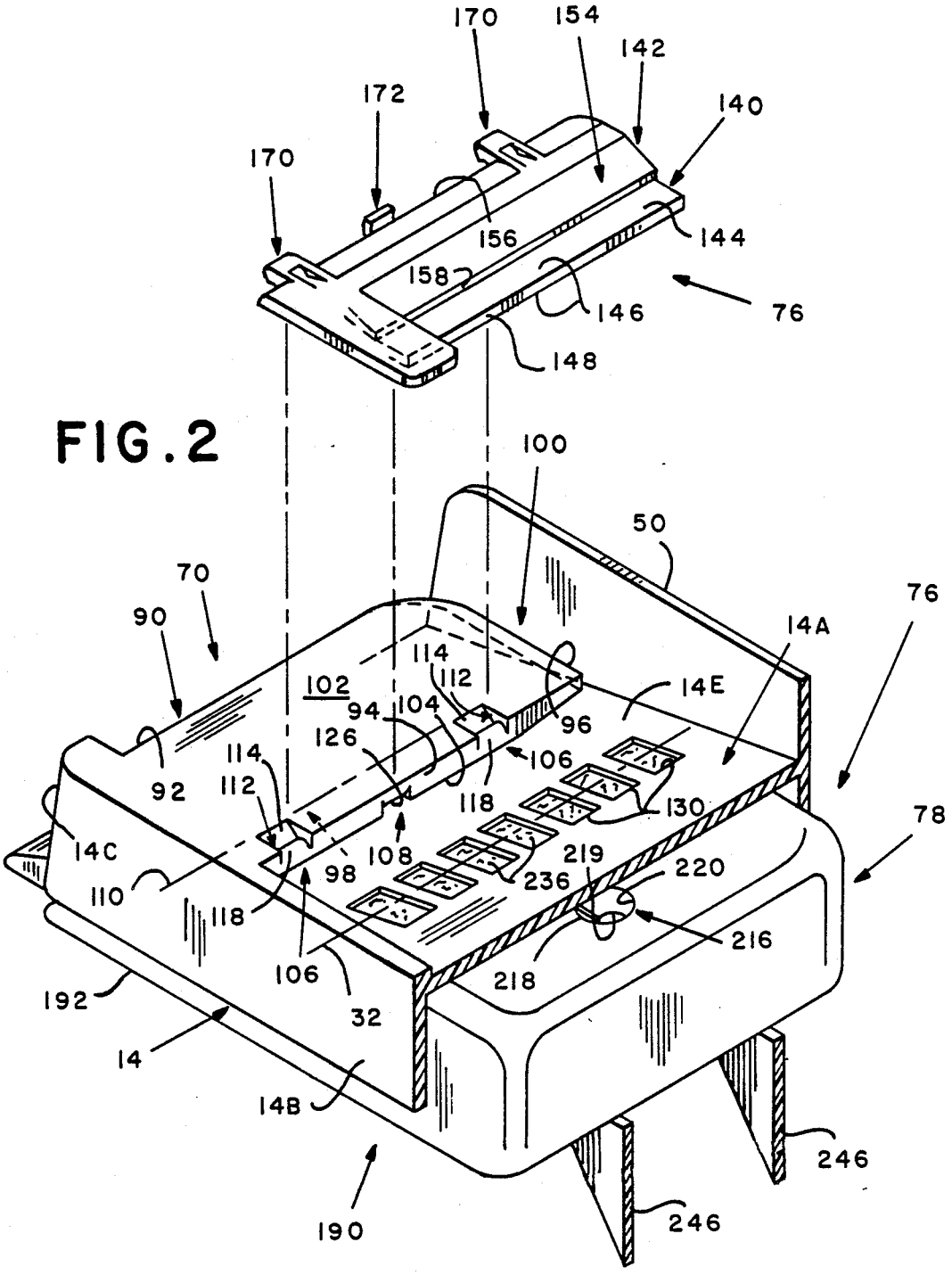
FIG. 2 is an exploded, partial, perspective view of the mailing machine of FIG. 1, showing details of the envelope flap moistening apparatus and an embodiment of the manner in which the applicator retainer thereof is adapted for removable connection to the machine's stripper blade.
Figure 3:
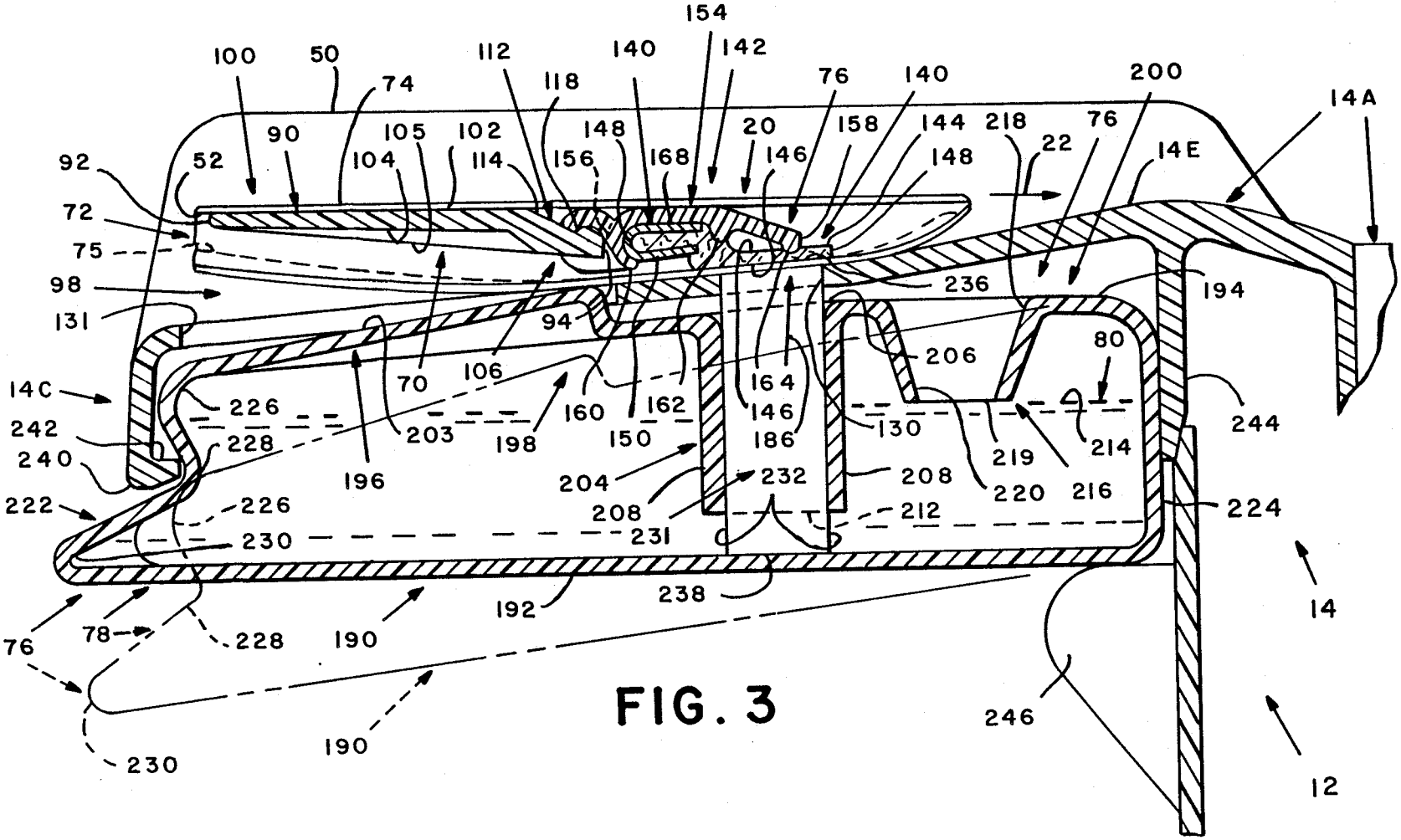
FIG. 3 is a section of FIG. 1, taken substantially along the line 3—3 thereof, showing the moistening applicator retainer, applicator pad and fluid supply.

As shown in FIG. 3, according to the invention, that portion 14E of the feed deck 14A which is located between the housing's front skirt wall 14B and alongside substantially the entire length of the registration fence 50, is located beneath the stripper blade 90 and is generally inclined upwardly at an angle relative to the direction of the path of travel 22 of sheets 20 fed to the machine 10. The feed deck's inclined portion 14E includes an opening 131, which is formed therein to accommodate integrally molding the stripper blade 90 and inclined deck portion 14E. Moreover, the inclined deck portion 14E of the feed deck 14A (FIG. 2) includes a plurality of apertures 130, known in the art as windows, which are formed in the inclined deck portion 14E at equally spaced intervals along an imaginary centerline 132, which extends parallel to the stripper blade's trailing edge 94 and is located downstream therefrom.

The flap moistening apparatus 76 (FIG. 1) generally includes a moistening fluid applicator 140 (FIG. 3), and an applicator retainer 142 which is preferably adapted to be removably attached to the stripper blade's trailing edge 94. The applicator 140 includes an elongate pad 144 (FIG. 2) having opposed, generally rectangularly-shaped surfaces 146 and opposed, longitudinally-extending side edges 148 (FIG. 3). In addition, the applicator 140 includes an elongate base portion or ferrule 150, which is U-shaped in traverse cross-section and dimensioned for receiving therein a longitudinally-extending, marginal portion of the pad 144 alongside one of the side edges 148 thereof. Moreover, the base portion 150 is preferably made of a non-corrosive material, and is suitably clamped to the opposed surfaces 146 of the pad 144 when the marginal portion of the pad 144 is received therein. Preferably, the pad 144 is made of a felt-like material such as a woven or spun bundle of natural or man-made fibers, or other material which is constructed and arranged to act as a wick for drawing fluid 80 by capillary action from the fluid supply 78 via the feed deck windows 130 (FIG. 2) for moistening the pad 144.

The applicator retainer 142 (FIG. 2) is an elongate member which is preferably a piece-part made of a resilient plastic material, such as polycarbonate or the like. The retainer 142 includes an upper wall portion 154 (FIG. 3) having opposed longitudinally-extending side edges including a leading edge 156 (FIG. 2) and a trailing edge 158. In addition, the retainer 142 (FIG. 3) includes first, second and third, longitudinally-extending, lower wall portions 160, 162 and 164, each of which depends from the upper wall portion 154. The lower wall portion 160 preferably extends curvedly downwardly from the upper wall portion's leading edge 156 and toward the lower wall portion 162. The lower wall portion 164 preferably extends vertically downwardly from the upper wall portion's trailing edge 158. And the lower wall portion 162 preferably extends downwardly from substantially midway between the upper wall portion's leading and trailing edges, 156 and 158, and toward the lower wall portion 156, to form therewith a longitudinally-extending channel 168 into which the applicator base portion 150 may be conventionally inserted against the resilient-force exerted thereon by the lower wall portions 160 and 162. Preferably, the downwardly extending length of the lower wall portion 162 is less than that of the lower wall portion 160, to permit the applicator pad 144 to extend downwardly from the channel 168, and thus toward the inclined deck portion 14E, and also downstream beneath the lower wall portion 164 and into overlying relationship with the deck windows 130 when the retainer 142 is connected to the stripper blade 90. To that end the pad wicking material is sufficiently flexible to permit flexure thereof toward and beneath the depending wall portion 164.

The applicator retainer 142 (FIG. 2) additionally includes a plurality of upper and lower elongate hinge segments, 170 and 172, preferably three, which extend upstream from the upper wall portion's leading edge 156. The hinge segments, 170 and 172, are alternately located at intervals along the upper wall portion's leading edge 156, for alignment on a one-for-one basis with the stripper blade's hinge segments, 106 and 108. Preferably, the upper two retainer hinge segments 170 (FIG. 5) each include an arcuately-shaped lower surface 173A which convexly, curvedly, extends upstream from the retainer's leading edge 156 for engagement with one of the stripper blade's correspondingly-shaped upper hinge segment surfaces 118. In addition, each of the retainer's hinge segments 170 includes a lower inclined surface 173B which inclines upwardly and upstream from the upstream end of the lower surface 173A. Further, the lower hinge segment 172 (FIG. 4), which is located midway between the hinge segments 170, includes an arcuately-shaped upper surface 173C which concavely, curvedly extends upstream from the leading edge 156 for engagement with the stripper blade's correspondingly-shaped lower hinge segment surface 126. Thus the stripper blade and retainer upper hinge segments 106 and 170 are configured for engagement with one another, as are the lower hinge segments 108 and 172.

Figure 5:
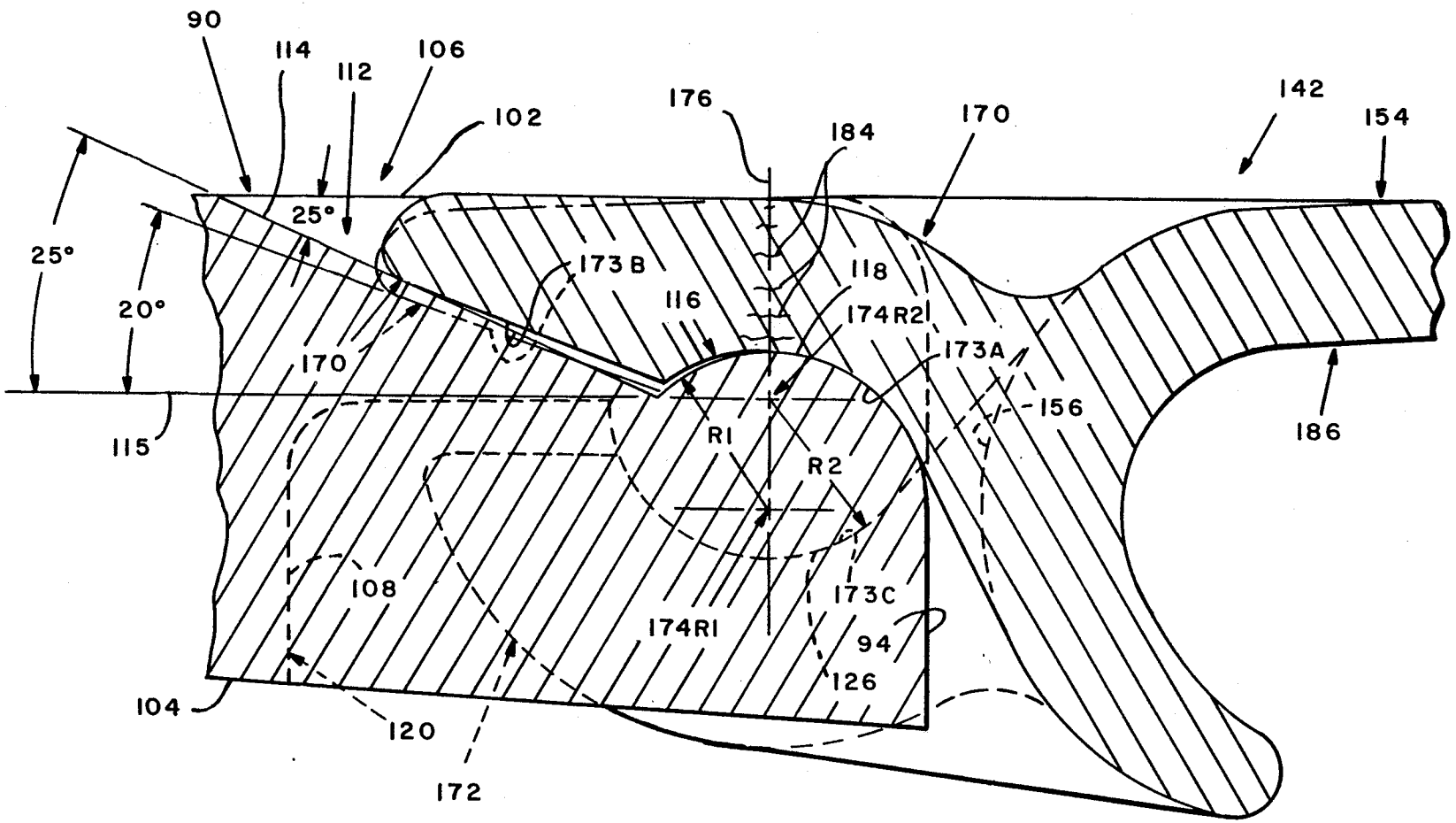
FIG. 5 is a partial section of FIG. 1, taken substantially along the line 5—5 thereof, showing the manner in which the outer hinge portions of the stripper blade and applicator retainer are adapted for interconnection with one another.

As shown in FIG. 5, when the applicator retainer 142 and stripper blade 90 are interconnected by means of their respective hinge segments 106, 108 and 170, 172, the respective axis 174(R1) and 174(R2) from which radii "R1" and "R2" may be drawn describing the respective stripper blade hinge segment surfaces 118, 173A and 126, 173C are offset from one another along an imaginary vertical plane 176 extending through the axis 174(R1) and 174(R2). As a result, when the retainer hinge segments, 170 and 172, are connected to the stripper blade hinge segments, 106 and 108, the retainer 142 is not mounted for rotation relative to the stripper blade 90. Rather, the retainer 142 is connected to the stripper blade 90, by means of the hinge segments 106, 108, 170 and 172, in a manner such that the retainer 142 (FIG. 3) is maintained in overhanging relationship with respect to the feed deck's inclined portion 14E, in a substantially horizontally-extending plane aligned with the stripper blade's upper surface 102, against upwardly directed forces which are applied to the retainer 142 (FIG. 3) when an envelope flap 72 is fed between the applicator pad 144 and feed deck windows 130.

Figure 4:
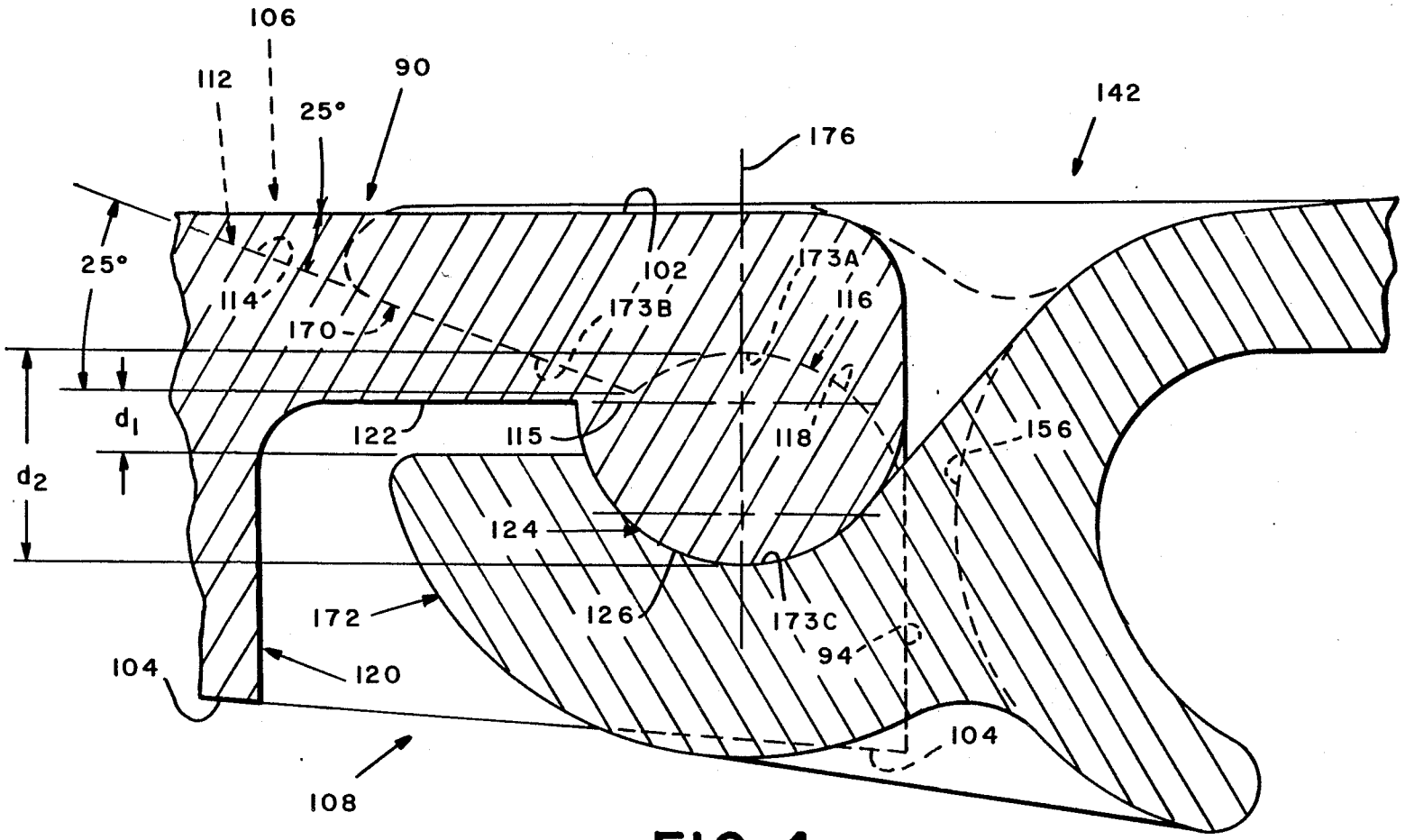
FIG. 4 is a partial section of FIG. 1, taken substantially along the line 4—4 thereof, showing the manner in which the inner or middle hinge portion of the stripper blade and applicator retainer are adapted for interconnection with one another.

More particularly, as shown in FIG. 4, due to the vertical distance "d1" between the retainer's upper and lower hinge segments, 170 and 172, being less than the maximum vertical distance "d2" between the stripper blades upper and lower segment surfaces, 118 and 126, when the retainer 142 is connected to the stripper blade, the upper and lower hinge segments, 170 and 172, are respectively raised and lowered against the resilient forces exerted thereby as the retainer's hinge segments 170 and 172 are urged upstream, through the vertical plane 176, into engagement with the hinge segments 106 and 108. Moreover, as shown in FIG. 5, prior to connection of the retainer 142 to the stripper blade 90, the lower, inclined surfaces 173B of the retainer's upper hinge segments 170 are preferably inclined upwardly at an angle of twenty degrees (20°) from the aforesaid horizontally-extending plane 115. And, since the stripper blade's inclined hinge segment surfaces 114 are formed at an angle of twenty-five degrees (25°) with respect to the horizontally-extending plane 115, in the course of connecting the retainer 142 to the stripper blade 90 the inclined surfaces 114 urge the retainer's upper hinge segments 170 five degrees (5°) upwardly against the resilient force exerted thereby on the inclined surfaces 114. As thus constructed and arranged the retainer's upper hinge segments 170 are resiliently pre-stressed, as represented by the wavy lines 184, along the aforesaid vertical plane 176, when engaged with the stripper blade upper hinge segments 106. Thus the hinge segments 106 and 170 are cooperatively configured for maintaining the retainer's upper wall portion 154, and thus the retainer 142, in a predetermined position of alignment with the stripper blade 90, for example in the aforesaid substantially horizontally-extending plane aligned with the stripper blade 90. Moreover, when an upwardly directed force 186 is applied to the retainer's upper wall portion 154, tending to rotate the retainer's hinge segments, 170 and 172, about the stripper blade's hinge segments, 106 and 108, then, the retainer's hinge segments, 170 and 172, tend to resiliently urge the retainer's upper wall portion 154 downwardly against the force 186, for maintaining the retainer's upper wall portion 154 in the aforesaid horizontal plane aligned with the stripper blade's upper surface 102. Thus the upper hinge segments 106 and 170 and lower hinge segments 108 and 172 are cooperatively configured for engagement with one another and for maintaining the retainer 142 in a predetermined position of alignment with the stripper blade 90. As a result, the applicator pad 144 (FIG. 3) is resiliently held and maintained in overlaying relationship with the feed deck windows 130 (FIG. 2) for drawing moistening fluid 80 (FIG. 3) therethrough from the supply 78 when an envelope 20 is not being fed to the machine 10.

Figure 6:
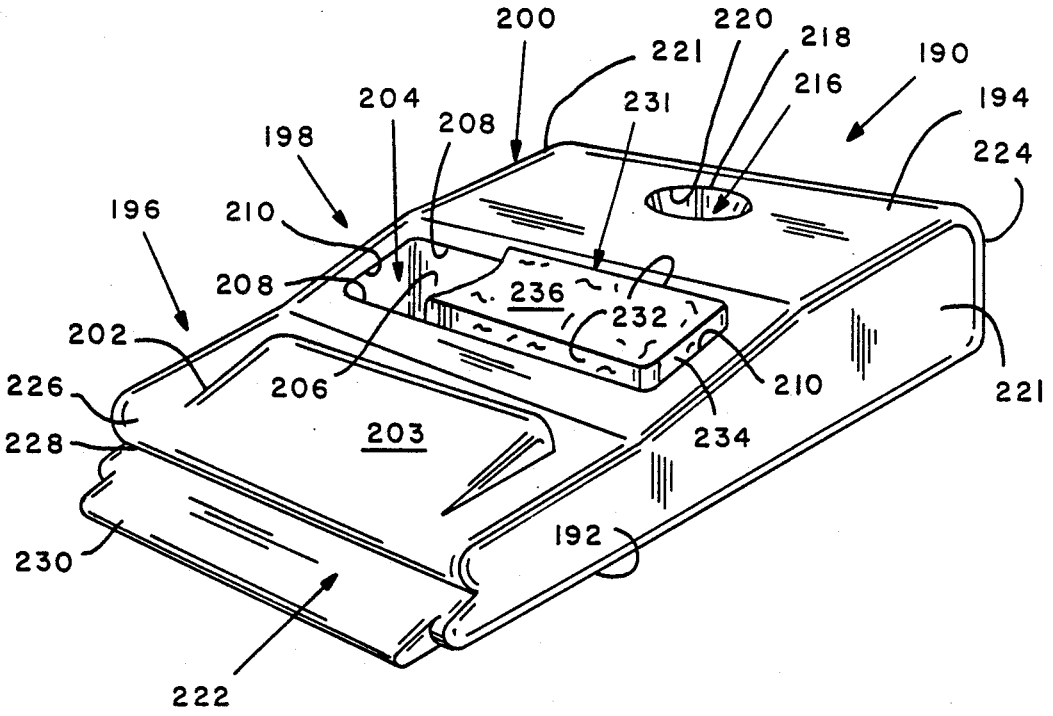
FIG. 6 is a perspective view of the moisture fluid supply according to the invention.

According to the invention, the source of supply 78 (FIG. 3) of flap moistening fluid 80 generally comprises a hollow, elongate container 190 for containing a fluid 80 such as water or any other solvent which is suitable for moistening the envelope flap's gummed strip of material 75 (FIG. 3). The container 190 (FIG. 6) has the general external appearance of a rectangularly-shaped solid and includes a flat, generally rectangularly-shaped lower wall 192 and an irregularly-shaped upper wall 194.

The upper wall 194 (FIG. 6) includes a forwardly disposed, generally horizontally-extending, section 196, an inclined mid-section 198 and a rearwardly disposed, generally horizontally-extending section 200. The forwardly disposed section 196 includes a generally rectangularly-shaped portion 202, the upper surface 203 of which is inclined at an angle relative to the container's lower surface 192 (FIG. 3) so as to extend through the opening 131 formed in the feed deck portion 14E. The upper wall's mid-section 198 (FIG. 6) includes an elongate well 204 (FIG. 6) formed therein. The well 204 has a rectangularly-shaped, fluid outlet opening 206. The well 204 includes a pair of opposed, longitudinally-extending, parallel-spaced, depending side walls 208, which extend downwardly from the outlet opening 206 and transverse to the longitudinal length of the container 190. In addition, the well 204 includes a pair of opposed, parallel-spaced, depending end walls 210, which extend downwardly from the outlet opening 206 and between the side walls 208. Preferably, the well's side walls 208 and end walls 210 are integrally formed with one another. The well 204 extends downwardly from the outlet opening 206 toward the container's lower wall 192 to define a rectangularly-shaped opening 212 (FIG. 3) in fluid-flow communication with the interior of the container 190 below the surface level 214 of the fluid 80 therein when the container 190 is filled with fluid 80. Further, the upper wall's rearwardly disposed section 200 (FIG. 6) includes a second well 216 formed therein, which preferably has a circularly-shaped, fluid inlet opening 218. The well 216 includes a generally cylindrically-shaped depending wall 220, which extends downwardly from the inlet opening 218 and partially into the interior of the container 190 (FIG. 3), to define a lower circularly-shaped opening 219 which is in fluid-flow communication with the interior of the container 190.

The container 190 (FIG. 6) additionally includes a pair of opposed, parallel-spaced, longitudinally-extending, side walls 221, which extend between and are integrally formed with the upper and lower walls, 194 and 192. Further, the container 190 includes front and rear side walls, respectively designated 222 and 224, each of which extends between and is integrally formed with the container's upper and lower walls, 194 and 192, and also extends between and is integrally formed with the container's side walls 221. Preferably, the front side wall 222 (FIG. 3) is generally S-shaped in transverse cross-section, and includes an upper, outwardly-curvedly-extending section 226, a middle, inwardly-curvedly-extending section 228, and a lower, outwardly-curvedly-extending section 230.

In addition, the source of supply 78 (FIG. 3) includes an elongate pad 231. The pad 231 is dimensioned for insertion into the well 204, and has opposed, generally rectangularly-shaped side surfaces 232 (FIG. 6), opposed longitudinally-extending, side edges, one of which is shown and designated 234, and upper and lower end edges, respectively designated 236 and 238 (FIG. 3). The pad 231 is made of a felt-like material such as a woven or spun bundle of natural or man-made fibers, or other material which is constructed and arranged to act as a wick for drawing fluid 80 by capillary action from the interior of the container 190 and, via the well 204, supplying the fluid 80 to the pad's upper end 236. Preferably, the pad's lower end 238 is seated on the inner surface of the container's lower wall 192, and the pad's upper end 236 extends out of the container's outlet opening 206, for wicking fluid therethrough and into overlaying relationship with the feed deck windows 130. Moreover, when the container 190 is mounted in place beneath the inclined portion 14E of the feed deck 14A, to ensure that the applicator pad 144 engages the fluid supply pad's upper end 236 when the applicator pad 144 is disposed in overlying relationship with the feed deck windows 130, the fluid supply pad's upper end 236 extends through the feed deck windows 130 for disposition in engagement with the applicator pad 144.

According to the invention, the machine's housing 14 (FIG. 3) is constructed and arranged for permitting the container 190 to be removably mounted beneath the inclined portion 14E of the feed deck 14A without the use of tools, to facilitate cleaning and refilling the container 190 with moistening fluid 80. To that end, housing's forward skirt wall 14C is constructed and arranged to be L-shaped in transverse cross-section, and the lower end 240 thereof includes a laterally-extending wall portion 242 which is configured for engaging the middle, inwardly-curvedly-extending section 228 of the container's front side wall 222. In addition, the base 12 includes a depending interior wall 244, which extends downwardly, within the base 12, from the downstream end of the inclined portion 14E of the feed deck 14A. Moreover, the base 12 includes at least one, and preferably a pair of parallel-spaced, plate-like brackets 246 (FIG. 2) which are integrally formed with, or otherwise securely connected to, the depending interior wall 244, and which extend therefrom and beneath the container's lower wall 192 for supporting the container 190 when the container 190 is mounted beneath the inclined portion 14E of the feed deck 14A.

As shown in FIG. 3, the mailing machine's operator can remove the container 190, and thus the fluid supply 78, from the machine's base 12 by manually pressing the container's lower wall section 230 downwardly, and then lowering the container's rear wall 224 from the brackets 246. Whereupon, the container 190 can be filled with moistening fluid 80 via the fluid supply opening 218. Thereafter, the fluid filled container 190 can be re-mounted in place beneath the inclined portion 14E of the feed deck 14A, by initially inserting the container's rear wall 224 beneath the inclined deck portion 14E and over the brackets 246, followed by raising the container's lower front wall section 230 upwardly until the skirt wall's lower wall portion 242 engages the container's middle, front wall section 226. To facilitate implementation of the above process, the container 190 is preferably made of a conventional resilient, plastic, material which is sufficiently resilient to permit flexure thereof relative to the skirt wall 14C when the container 190 is removed from, and mounted in place, beneath the feed deck 14A. Thus, the container 190 is both removed from, and mounted in place, beneath the feed deck 14A against the resilient force exerted by the container 190 against the skirt wall 14C.

In operation, when an open envelope 20 (FIG. 2) is fed to the upper surface 102 of the stripper blade 90, the operator urges the envelope's flap edge 52 into engagement with the registration fence 50 and downstream in the direction of the path of travel 22. As the envelope 20 is progressively fed downstream, the stripper blade's leading edge 92 separates the envelope's flap 72 from the envelope's body 74. Whereupon the envelope's body 74 is fed downstream on the stripper blade's upper surface 102 as the stripper blade's rib(s) 105 (FIG. 3) guide the envelope flap 72 downwardly through the gap 100 and into channel 98 beneath the stripper blade 90. As a result, the gummed strip of material 75 affixed to the interior of the envelope flap 72, is faced upwardly within the channel 98 and is exposed for moistening purposes. As the envelope 20 is further fed downstream, the envelope flap 72 engages the upwardly inclined feed deck portion 14E, which guides the progressively moving envelope flap 72 upwardly beneath the stripper blade's trailing edge 94, and then beneath the retainer 142 and moisture applicator pad 144. As the envelope flap 72 is fed beneath the pad 144, the flap 72 raises the pad 144 against the resilient force exerted by the retainer hinge segments, 170 and 172, which resiliently maintain the pad 144 in engagement with the envelope flap 72, as the flap 72 is fed beneath the pad 144, for transferring moisture from pad 144 to the flap's gummed strip of material 75. As the envelope 20 is fed still further downstream in the direction of the path of travel 22, the envelope 20 engages and moves the trip lever 54 (FIG. 1), causing the drive system 44 to be actuated. Whereupon the drive system 44 causes the lever arm 40 to move the shutter bar 32 out of locking engagement with the drum drive gear 26. Thereafter the drive system 44 commences rotating the output drive gear 46, and thus the drum drive gear 26 and postage meter drum 24, and the impression roller 60 and ejection roller 62, in timed relationship with one another, for feeding the envelope 20 through the machine 10, as the drum 24 prints indicia on the envelope body 74, and then from the machine 10. As the postage meter drum 24 and impression roller 60, and thereafter the postage meter idler roller 66 and ejection roller 62, rotate in engagement with the envelope 20, the pressure exerted thereby against the envelope flap 72 and, in particular against that portion of the flap 72 which includes the gummed strip of material 75, causes the moistened, gummed strip of material to seal the envelope's flap 72 to the envelope's body 74.

Figure 7:
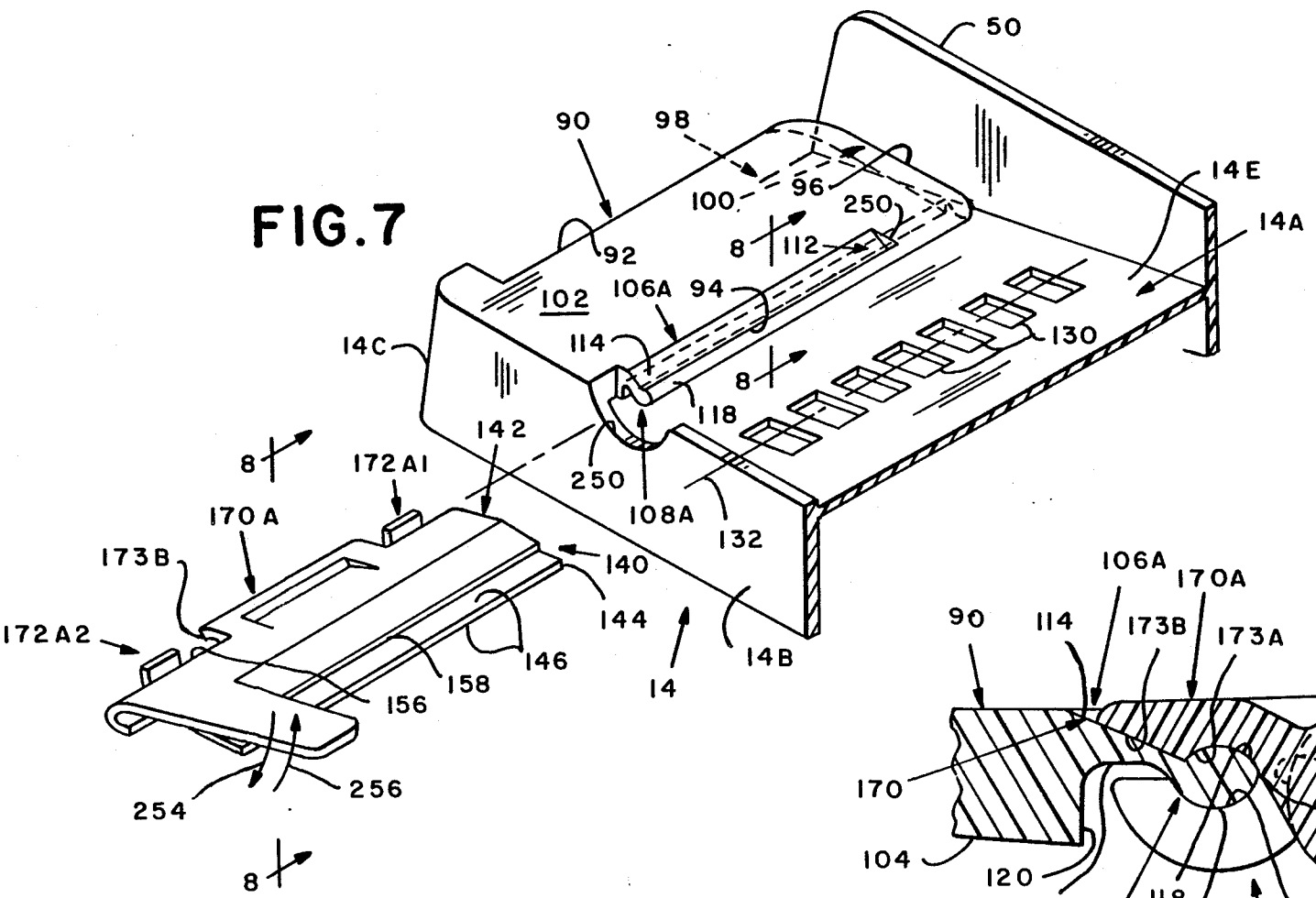
FIG. 7 is an exploded, partial perspective view of a mailing machine similar to FIG. 2, showing details of an alternate embodiment of the apparatus shown in FIG. 2.
Figure 8:
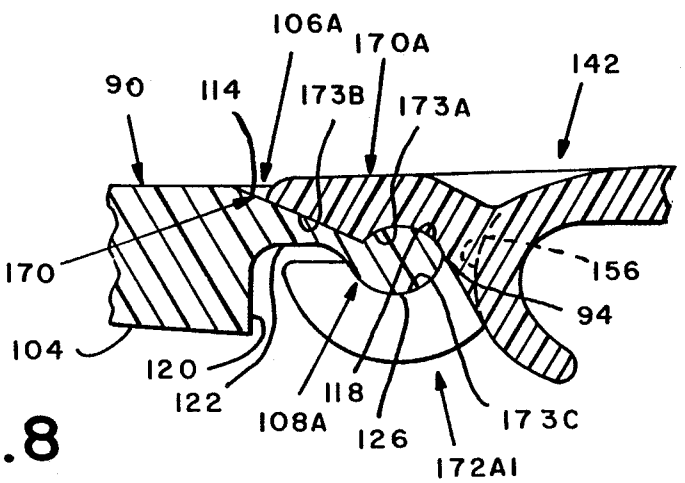
FIG. 8 is a section of FIG. 7, taken substantially along the line 8—8 thereof, showing the manner in which the stripper blade and applicator retainer of FIG. 7 interconnect with one another.

According to the invention, an alternate, preferred, embodiment of hinge structure 106, 108, 170, 172 of FIG. 2, for removably interconnecting the applicator retainer 142 to the stripper blade 90 is shown in FIGS. 7 and 8. As shown in FIG. 7, to accommodate slidably connecting or disconnecting the retainer 142 to or from the stripper blade 90, the skirt wall 14C includes an aperture 250 formed therein adjacent to the stripper blade's trailing edge 94. In addition, rather than the retainer 142 (FIG. 2) including two upper, spaced, hinge segments 170, and one lower, middle, hinge segment 172, the retainer shown in FIG. 7 includes one upper, middle, hinge segment 170A and two lower, spaced, hinge segments designated 172A1 and 172A2.

Further, the upper, middle, hinge segment 170A is preferably wider in width, as measured along the leading edge 156 of the retainer 142, than the upper hinge segments 172A1 and 172A2. Further, rather than the stripper blade 90 (FIG. 2) including one, lower, middle, hinge segment 108, the stripper blade 90 shown in FIG. 7 includes one, elongate, lower hinge segment 108A which longitudinally extends from the aperture 250 formed in the front skirt wall 14C and alongside the stripper blade's trailing edge 94 to the stripper blade's side edge 96. And, rather than the stripper blade 90 (FIG. 2) including two upper, spaced, hinge segments 106, the stripper blade 90 shown in FIG. 7 includes one, elongate, upper hinge segment 106A which longitudinally extends from the skirt wall's aperture 250 and alongside the stripper blade's trailing edge 84 to a stop surface 252 which is spaced apart from the stripper blade's side edge 96 a distance which corresponds, substantially, to the width of one of the retainer hinge segments 172A1 or 172A2. Apart from these differences, the stripper blades and retainers, 90 and 142 of FIGS. 2 and 7, and of FIGS. 4, 5 and 8, are in all respects the same, as a consequence of which the numerical designations associated therewith in FIG. 2, 4 and 5 have been retained in FIGS. 7 and 8. Moreover except for the following discussion, the discussion concerning the structures shown in FIGS. 2, 4 and 5 applies with equal force to structures shown in FIGS. 7 and 8.

As shown in FIGS. 7 and 8, the retainer hinge segments 170A, and 172A1 and 172A2, are slidably engageable with the stripper blade hinge segments 106A and 108A. In the course of such sliding engagement, the retainer's hinge segment 172A1 is initially slidably engaged with the stripper blade's hinge segment 108A, followed by sliding engagement of the retainer's hinge segment 170A with the stripper blade's hinge segment 106A, and then by sliding engagement of the retainer's hinge segment 172A2 with the stripper blade's hinge segment 108A. To facilitate such sliding engagement, as the retainer's middle hinge segment 170A is initially slidably engaged with the stripper blade's upper hinge segment 106A, the retainer 142 is preferably flexed clockwise as shown by the arrow 254, against the resilient force exerted by the retainer's hinge segment 172A1 against the stripper blade's hinge segment 108A. Whereupon, the hinge segments 170A and 106A can thereafter be slidably engaged against the resilient force exerted by the retainer's hinge segment surface 173B against the stripper blade's hinge segment surface 114. Further, after slidably engaging the retainer's middle hinge segment 170A with the stripper blade's upper hinge segment 106A, as the retainer's other lower hinge segment 172A2 is initially slidably engaged with the stripper blade's lower hinge segment 108A, the retainer 142 is preferably flexed counter-clockwise, as shown by the arrow 256, against the resilient forces hereinbefore discussed. Whereupon the hinge segments 172A2 and 106A can be thereafter slidably engaged with one another, against the aforesaid resilient forces, until the retainer's middle hinge segment 170A engages the stripper blade's stop surface 250. At which time the retainer 142 is properly located in engagement with the stripper blade 90 for maintaining the moisture applicator pad 140 in overhanging relationship with the inclined portion 14E of the feed deck 14A as hereinbefore discussed.

In accordance with the objects of the invention there has been described improved moistening fluid supplying structure.

Inasmuch as certain changes may be made in the above described invention(s) without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. Fluid supply apparatus comprising:

(a) a hollow container made of a resilient plastic material, the container including an upper wall, the upper wall including first and second wells formed therein and extending into the interior of the container, one of said wells forming a fluid inlet opening;

(b) a pad made of a wicking material, the other of said wells forming a fluid outlet opening, said pad mounted within the other of said wells and extending from said container via said fluid outlet opening; and (c) the container including a side wall having a generally S-shaped transverse cross-section.

2. The apparatus according to claim 1, wherein the upper wall includes a rearwardly-extending wall section including said inlet opening, and said inlet opening being, and said inlet opening circularly-shaped.

3. The apparatus according to claim 1, wherein the upper wall includes a middle wall section having said other of said walls formed therein, and said outlet opening being rectangularly-shaped.

4. The apparatus according to claim 1, wherein said upper wall includes a forwardly-extending section including a raised rectangularly-shaped portion thereof having an inclined upper wall portion.

5. The apparatus according to claim 2, wherein said one of said wells has a generally cylindrically-shaped wall portion extending into the interior of the container from said inlet opening.

6. The apparatus according to claim 3, wherein said container includes a substantially flat lower wall, and said other of said wells including wall portions thereof extending into the interior of the container from said outlet opening and having a lower opening thereinto which is located above the container's lower wall and in fluid flow communication with the interior of the container when the container is filled with fluid.

7. The apparatus according to claim 6, wherein the pad is seated on said lower wall and supported within said container by said well wall portions when said pad is mounted within said container.

8. The apparatus according to claim 1, wherein said side wall includes an inwardly-curvedly-extending middle portion and an outwardly-curvedly-extending lower portion.

9. The apparatus according to claim 8, wherein said side wall includes upper portion which is sufficiently thin walled to permit flexure thereof.

* * * * *